US008801212B2

(12) United States Patent
Chen

(10) Patent No.: US 8,801,212 B2
(45) Date of Patent: Aug. 12, 2014

(54) HANDHELD ILLUMINATION DEVICE

(71) Applicant: Chao-Ming Chen, Taichung (TW)

(72) Inventor: Chao-Ming Chen, Taichung (TW)

( * ) Notice: Subject to any disclaimer, the term of this patent is extended or adjusted under 35 U.S.C. 154(b) by 59 days.

(21) Appl. No.: 13/676,940

(22) Filed: Nov. 14, 2012

(65) Prior Publication Data

US 2014/0133135 A1 May 15, 2014

(51) Int. Cl.
*B25B 23/18* (2006.01)

(52) U.S. Cl.
CPC ..... *B25B 23/18* (2013.01)
USPC ..... 362/119; 362/120; 362/191; 362/578

(58) Field of Classification Search
CPC ..... B25B 23/18; B25B 15/02; B25B 13/06; B25B 13/08; B25B 21/00; B25B 23/16; F21V 33/0084; F21V 23/0414; F21V 21/0965; F21V 21/145
USPC ..... 362/119, 120, 191, 202, 188, 578; 81/439, 451, 479
See application file for complete search history.

(56) References Cited

U.S. PATENT DOCUMENTS

| | | | | |
|---|---|---|---|---|
| 2002/0141180 | A1* | 10/2002 | Liao | 362/119 |
| 2002/0145866 | A1* | 10/2002 | Chen | 362/120 |
| 2003/0043574 | A1* | 3/2003 | Hsien | 362/119 |
| 2008/0289843 | A1* | 11/2008 | Townsan | 173/216 |
| 2010/0296271 | A1* | 11/2010 | Chien | 362/119 |
| 2011/0063820 | A1* | 3/2011 | Wang | 362/120 |
| 2011/0216528 | A1* | 9/2011 | Hung | 362/120 |

* cited by examiner

*Primary Examiner* — Anh Mai
*Assistant Examiner* — Kevin Quarterman

(57) ABSTRACT

A handheld illumination device contains a body held by a user and including a through hole defined in the body, a connecting portion formed on a front end of the body, and a holding portion arranged on a rear end of the body; an operating member including a working segment defined on a front end thereof, a shank formed on a rear end of the operating member and inserted into the connecting portion of the body, the shank having a groove defined therein and communicating with the working segment; a lamp module fixed in the holding portion of by using the seat in which a light-emitting element, a battery pack, and a control button are disposed, the light-emitting element emitting light via the through hole and the groove so as to illuminate an work position relative to the working segment of the operating member.

6 Claims, 9 Drawing Sheets

HANDHELD ILLUMINATION DEVICE

FIELD OF THE INVENTION

The present invention relates to a handheld illumination device which illuminates tool parts and drives an operating member for connecting or disconnecting the tool parts.

BACKGROUND OF THE INVENTION

A conventional illumination device (such as a flashlight) is used to illumine a dim work space. For example, the user holds the illumination device with one hand and holds an operating member of a hand tool, thus causing inconvenience. To overcome such a problem, an illuminative hand tool is developed. As shown in FIG. 1, the illuminative hand tool 10 includes a shank 11 with a working segment 111, and the shank 11 has a grip 12 extending outwardly from a rear end thereof. The grip 12 has a lamp 13 mounted on a front end thereof, a battery fixed in the grip 12 and electrically connecting with the lamp 13, and a button 14 secured on a rear end of the grip 12 so as to turn on or turn off the lamp 13. However, such an illuminative hand tool 10 still has the following shortcomings:

1. Since the shank 11 (such as a screwdriver rod) is fixed on a front end of the grip 12, the illuminative hand tool 10 is portable inconveniently and injures people easily.
2. Because the lamp 13 is mounted on the front end of the grip 12, when operating the illuminative hand tool 10 in a narrow space, the shank 11 cannot be inserted into the narrow space, and the lamp 13 cannot emit light to the narrow space.
3. The lamp 13 is mounted on the front end of the grip 12, so it is broken easily.

The present invention has arisen to mitigate and/or obviate the afore-described disadvantages.

SUMMARY OF THE INVENTION

The primary object of the present invention is to provide a handheld illumination device in which the light-emitting element emits light via the through hole of the body so as to illuminate tool parts.

Further object of the present invention is to provide a handheld illumination device in which the connecting portion drives the operating member, and the light-emitting element emits light via the through hole of the body and the groove of the shank so as to illuminate a work position relative to the working segment of the operating member.

Another object of the present invention is to provide a handheld illumination device in which the light-emitting element is fixed in the body, thus preventing the light emitting element from impact damage.

To obtain the above objective, a handheld illumination device provided by the present invention contains:

a body held by a user and including a through hole defined in the body, a connecting portion formed on a front end of the body, and a holding portion arranged on a rear end of the body;

an operating member including a working segment defined on a front end thereof, a shank formed on a rear end of the operating member and inserted into the connecting portion of the body, the shank having a groove defined therein and communicating with the working segment;

a lamp module fixed in the holding portion of the body by ways of the seat in which a light-emitting element, a battery pack, and a control button are disposed, the light-emitting element emitting light via the through hole of the body and the groove of the shank so as to illuminate an work position relative to the working segment of the operating member.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
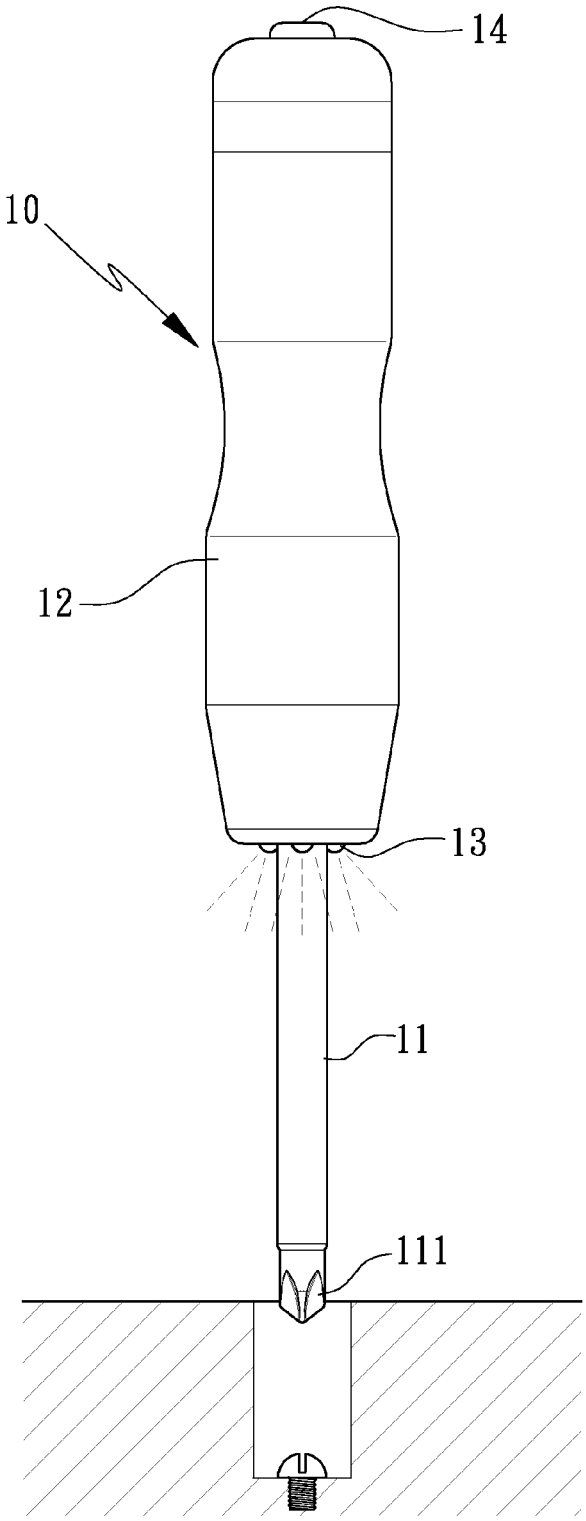
F I G . 1 PRIOR ART
FIG. 1 is a conventional illuminative hand tool.
Figure 2:
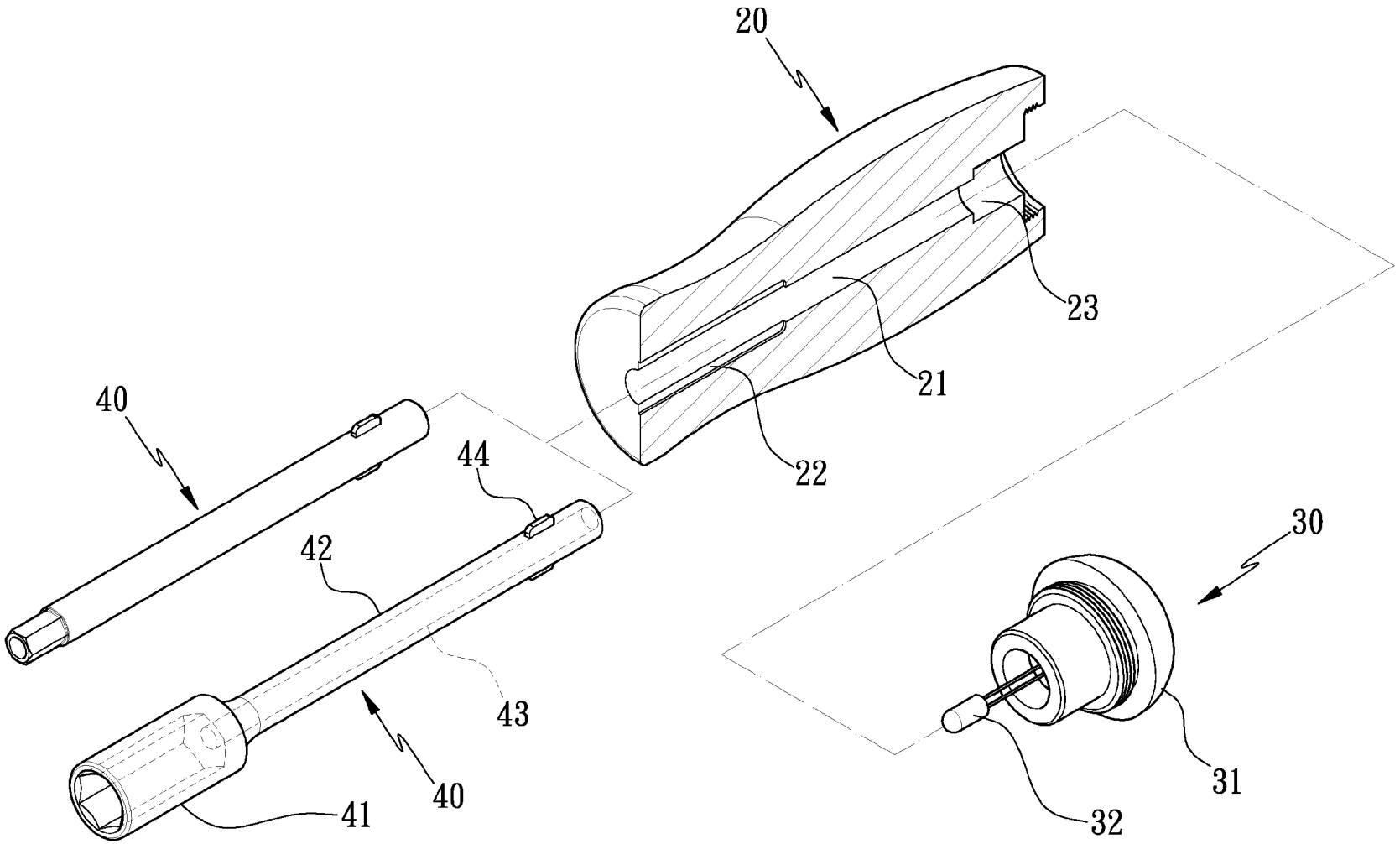
FIG. 2 is a perspective view showing the exploded components of a handheld illumination device according to a first embodiment of the present invention.
Figure 3:
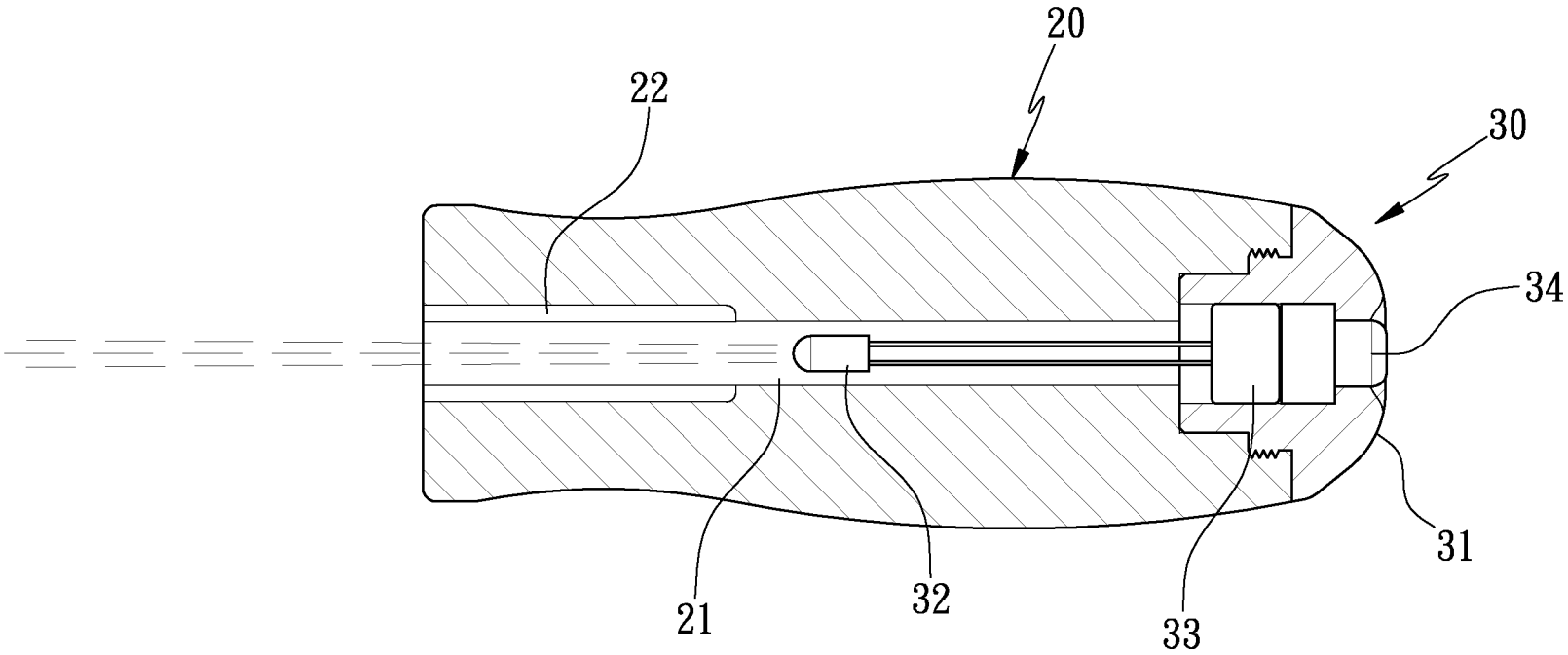
FIG. 3 is a cross sectional view showing the operation of the handheld illumination device according to the first embodiment of the present invention.

With reference to FIGS. 2 and 3, a handheld illumination device according to a first embodiment of the present invention comprises a body 20, a lamp module 30, and an operating member 40. The body 20 includes an outer surface for being held by a user, a through hole 21 defined in the body 20, a connecting portion (i.e., two slots 22) formed on two sides of a front end of the through hole 21, and a holding portion 23 arranged on a rear end of the body 20. The lamp module 30 includes a seat 31 in which a light-emitting element 32 is disposed and a battery pack 33 is electrically with the light-emitting element 32. The lamp module 30 also includes a control button 34 for controlling the light-emitting element 32 to electrically connect with the battery pack 33 or to disconnect from the battery pack 33 so that the light-emitting element 32 is turned on or turned off. In this embodiment, the control button 34 extends out of a rear end of the seat 31 and is pressed so as to electrically connect the light-emitting element 32 with the battery pack 33 or to disconnect the light-emitting element 32 from the battery pack 33 such that the light-emitting element 32 is turned on or turned off. The lamp module 30 is fixed in the holding portion 23 of the body 20 by ways of the seat 31. In this embodiment, the seat 31 is screwed in the holding portion 23 of the body 20.

The operating member 40 is used to connect or disconnect various tool parts and includes a working segment 41 defined on a front end of the operating member 40 and includes a shank 42 formed on a rear end of the operating member 40. The shank 42 has a groove 43 defined therein and communicating with the working segment 41 and has two tabs 44 secured on two sides of an outer wall thereof, such that when the shank 42 is inserted into the through hole 21 of the body 20, the two tabs 44 retain with the connecting portion (i.e., the two slots 22) of the through hole 21, the body 20 drives the operating member 40 to rotate by using the connecting portion (i.e., the two slots 22).

Referring to FIG. 3, as using the handheld illumination device to illuminate an object, the light-emitting element 32 emits light via the through hole 21 of the body 20, and the handheld illumination device only comprises the body 20 and the lamp module 30, hence the handheld illumination device is portable easily.

Figure 4:
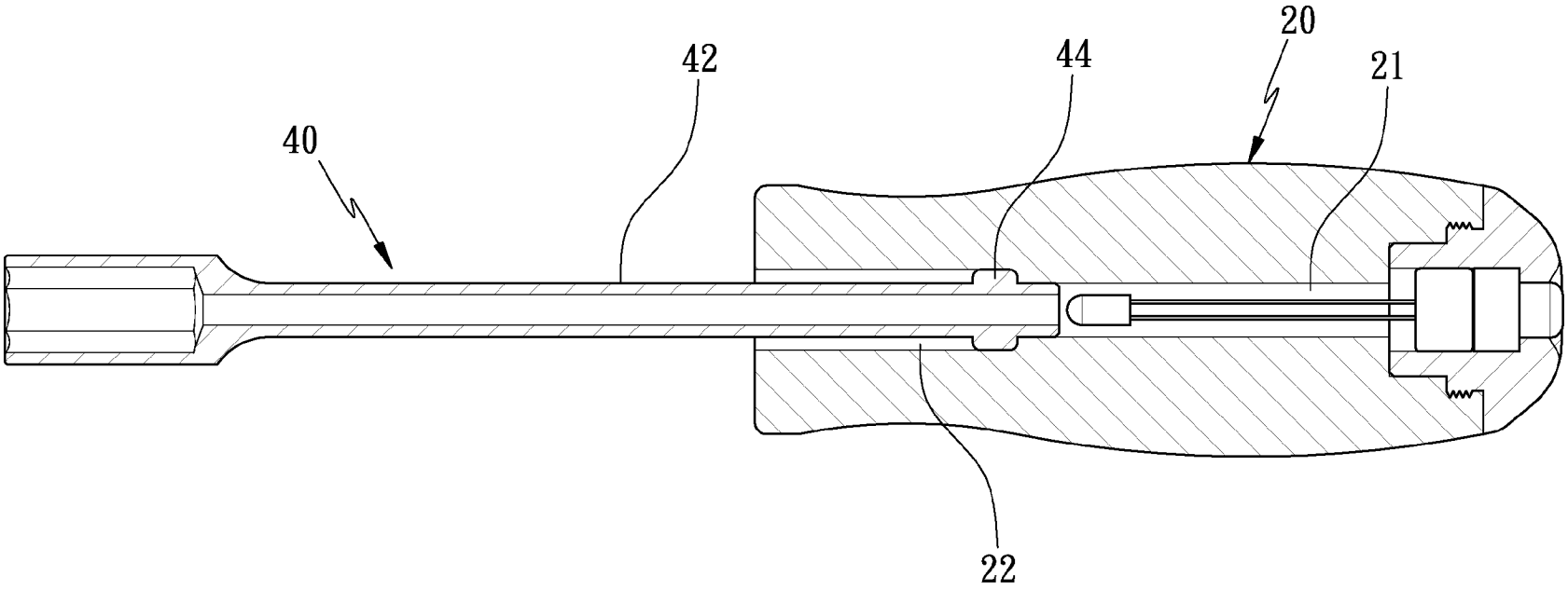
FIG. 4 is another cross sectional view showing the operation of the handheld illumination device according to the first embodiment of the present invention.
Figure 5:
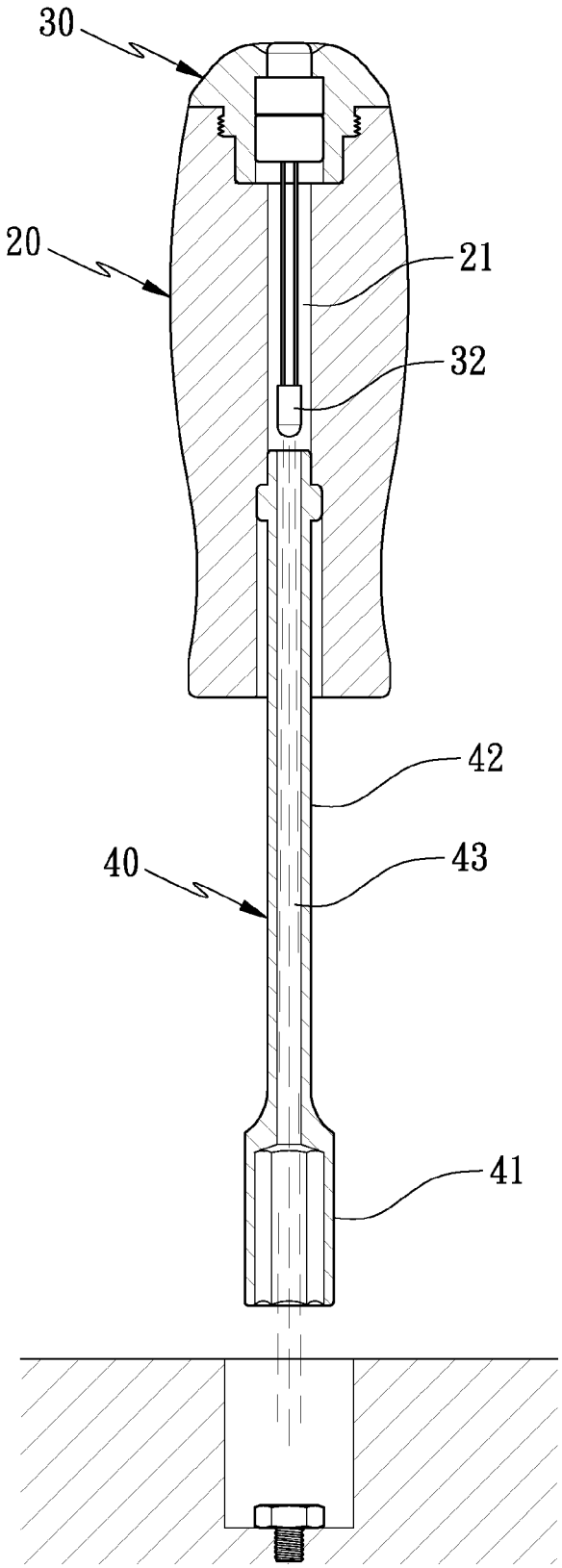
FIG. 5 is also another cross sectional view showing the operation of the handheld illumination device according to the first embodiment of the present invention.

As shown in FIG. 4, in operation, the shank 42 of the operating member 40 is inserted into the through hole 21 of the body, and the two tabs 44 retain with the connecting portion (i.e., the two slots 22) of the through hole 21 so that the body 20 drives the operating member 40 to rotate by means of the connecting portion (i.e., the two slots 22), thus connecting or disconnecting the tool parts. As illustrated in FIG. 5, when turning on the lamp module 30, the light-emitting element 32 emits light via the through hole 21 of the body 20 and the groove 43 of the shank 42 so as to illuminate an work position relative to the working segment 41 of the operating member 40, such that when the handheld illumination device is applied in a narrow space, it illuminates the work position clearly. In addition, the light-emitting element 32 is fixed in the body 20, thus preventing the light emitting element 32 from impact damage.

Figure 6:
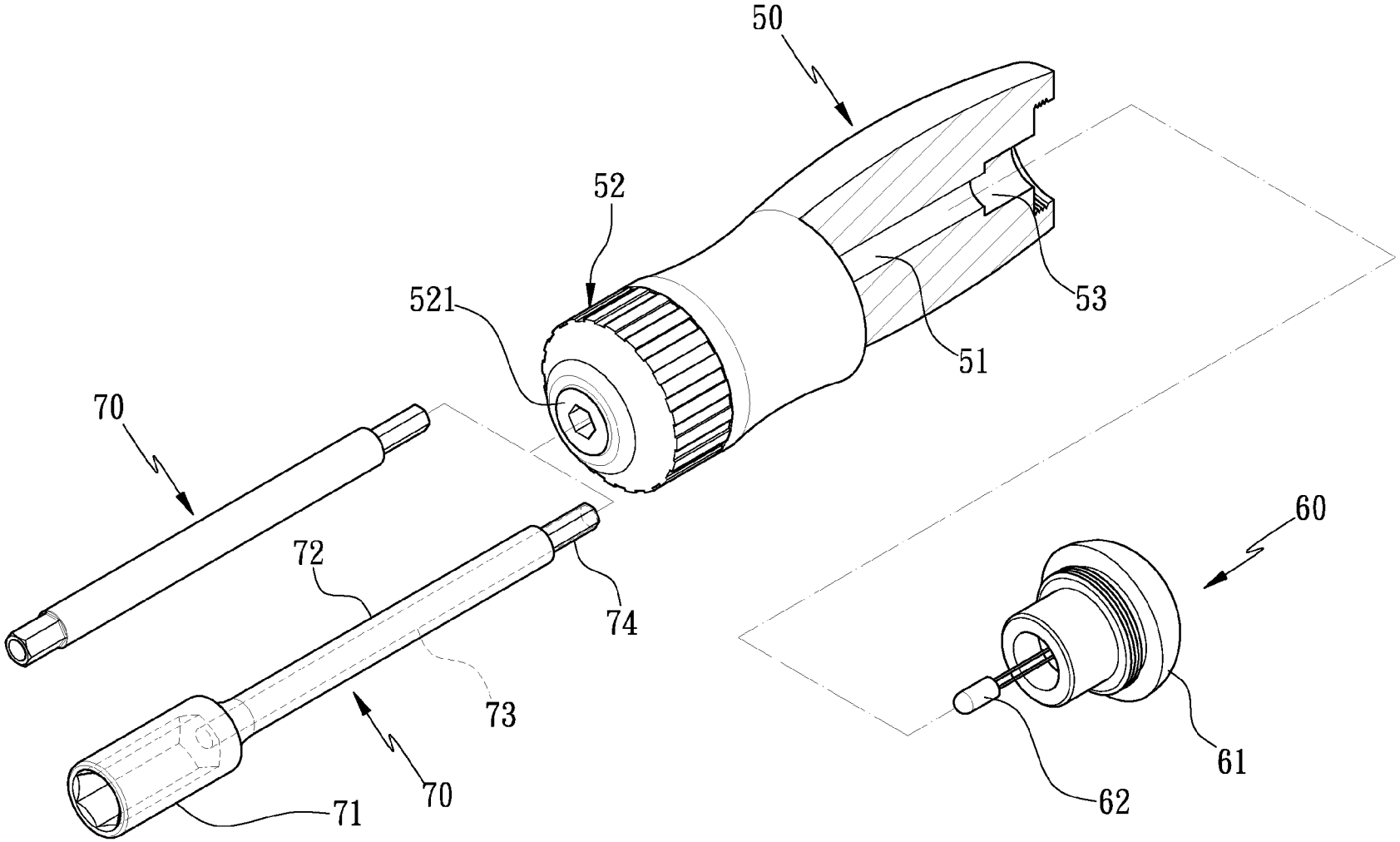
FIG. 6 is a perspective view showing the exploded components of a handheld illumination device according to a second embodiment of the present invention
Figure 7:
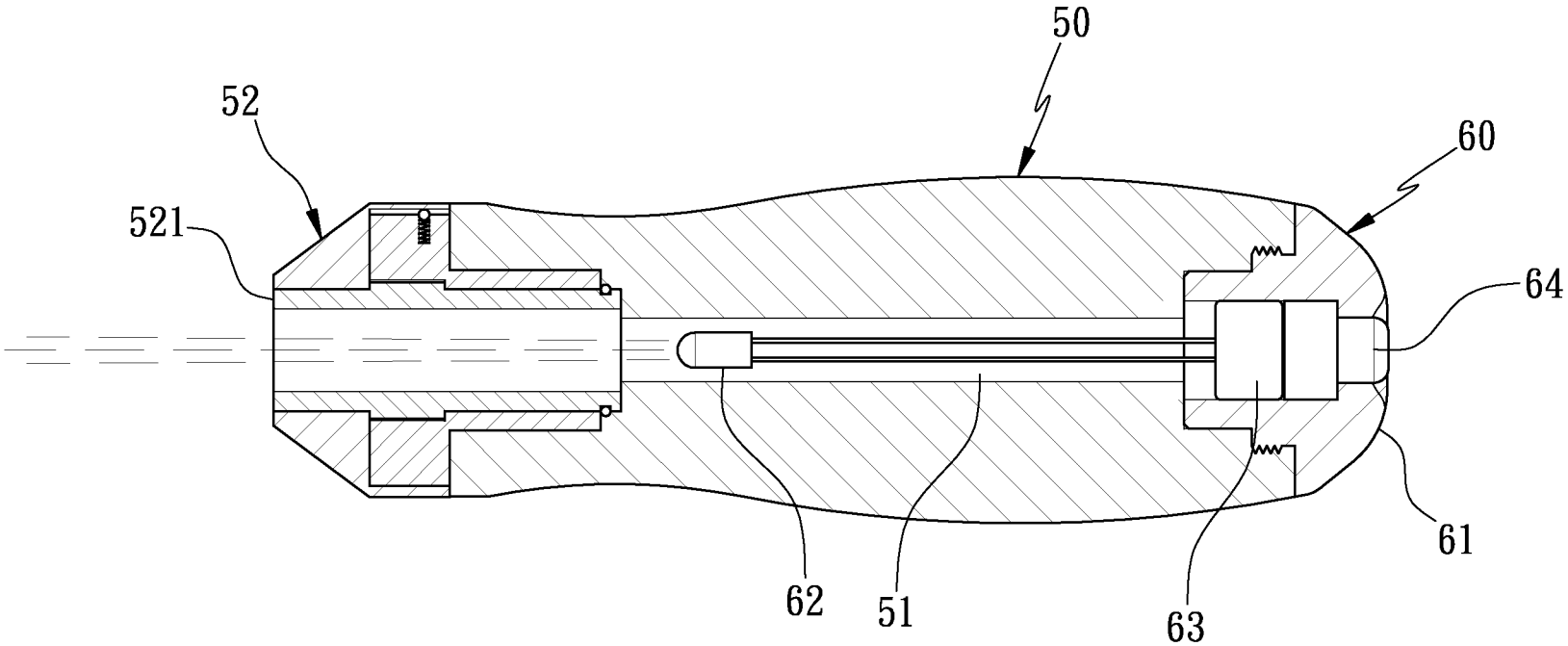
FIG. 7 is a cross sectional view showing the operation of the handheld illumination device according to the second embodiment of the present invention.

With reference to FIGS. 6 and 7, a handheld illumination device according to a second embodiment of the present invention comprises a body 50, a lamp module 60, and an operating member 70. The body 50 includes an outer surface for being held by a user, a ratchet assembly 52 with a fitting tube 521 so as to be used as a connecting portion. Due to the ratchet assembly 52 is a well-know art, further remarks are omitted. The body 50 also includes a through hole 51 defined therein and communicating with the fitting tube 521 and includes a holding portion 53 arranged on a rear end of the body 50. The lamp module 60 includes a seat 61 in which a light-emitting element 62 is disposed and a battery pack 63 is electrically with the light-emitting element 62. The lamp module 60 also includes also a control button 64 for controlling the light-emitting element 62 to electrically connect with the battery pack 63 or to disconnect from the battery pack 63 so that the light-emitting element 62 is turned on or turned off. In this embodiment, the control button 64 extends out of a rear end of the seat 61 and is pressed so as to electrically connect the light-emitting element 62 with the battery pack 63 or to disconnect the light-emitting element 62 from the battery pack 63 such that the light-emitting element 62 is turned on or turned off. The lamp module 60 is fixed in the holding portion 53 of the body 50 by ways of the seat 61. In this embodiment, the seat 61 is screwed in the holding portion 53 of the body 50. The operating member 70 is used to connect or disconnect various tool parts and includes a working segment 71 defined on a front end of the operating member 70 and includes a shank 72 formed on a rear end of the operating member 70. The shank 72 has a groove 73 defined therein and communicating with the working segment 71 and has a coupling segment 74 extending outwardly from a rear end of the shank 72, such that when the shank 72 is inserted into the connecting portion (i.e., the ratchet assembly 52) of the body 50, the body 50 drives the operating member 70 by inserting the coupling segment 74 into the fitting tube 521 of the ratchet assembly 52.

Referring to FIG. 7, as using the handheld illumination device to illuminate an object, the light-emitting element 62 emits light via the through hole 51 of the body 50 and the fitting tube 521 of the ratchet assembly 52, and the handheld illumination device only comprises the body 50, the lamp module 60, and the ratchet assembly 52, hence the handheld illumination device is portable easily.

Figure 8:
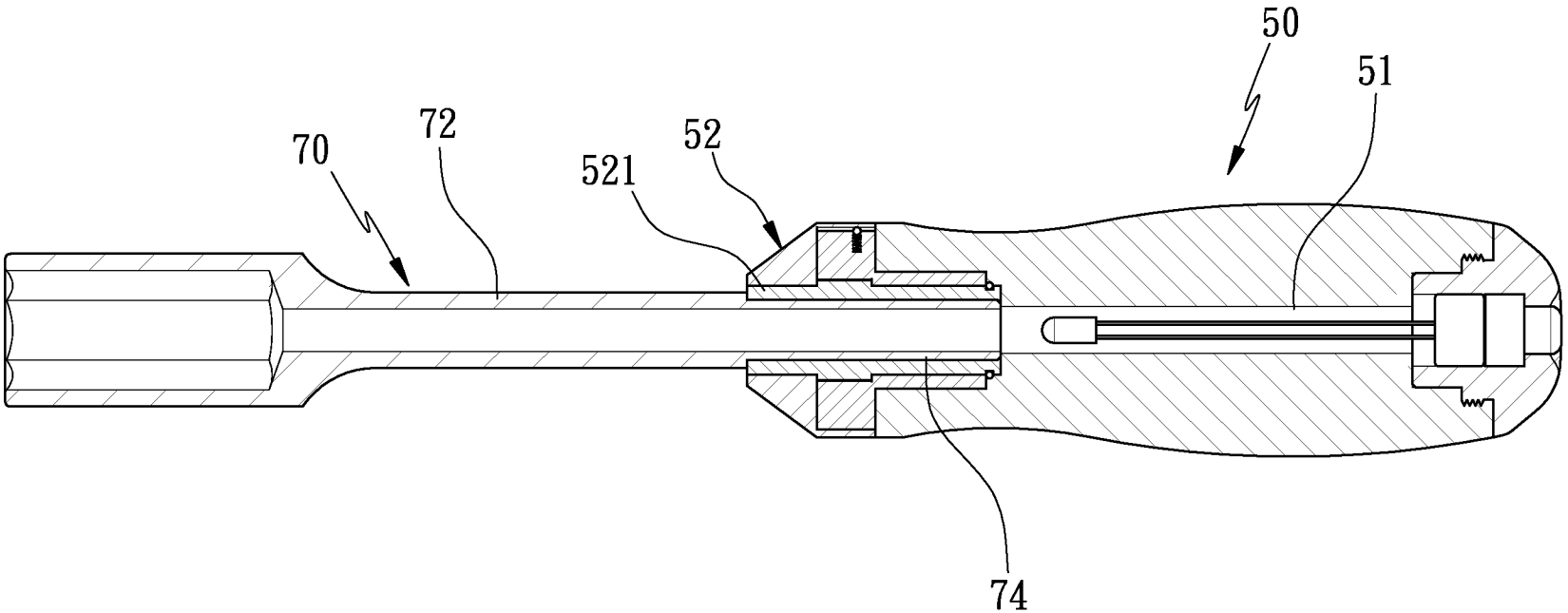
FIG. 8 is another cross sectional view showing the operation of the handheld illumination device according to the second embodiment of the present invention.
Figure 9:
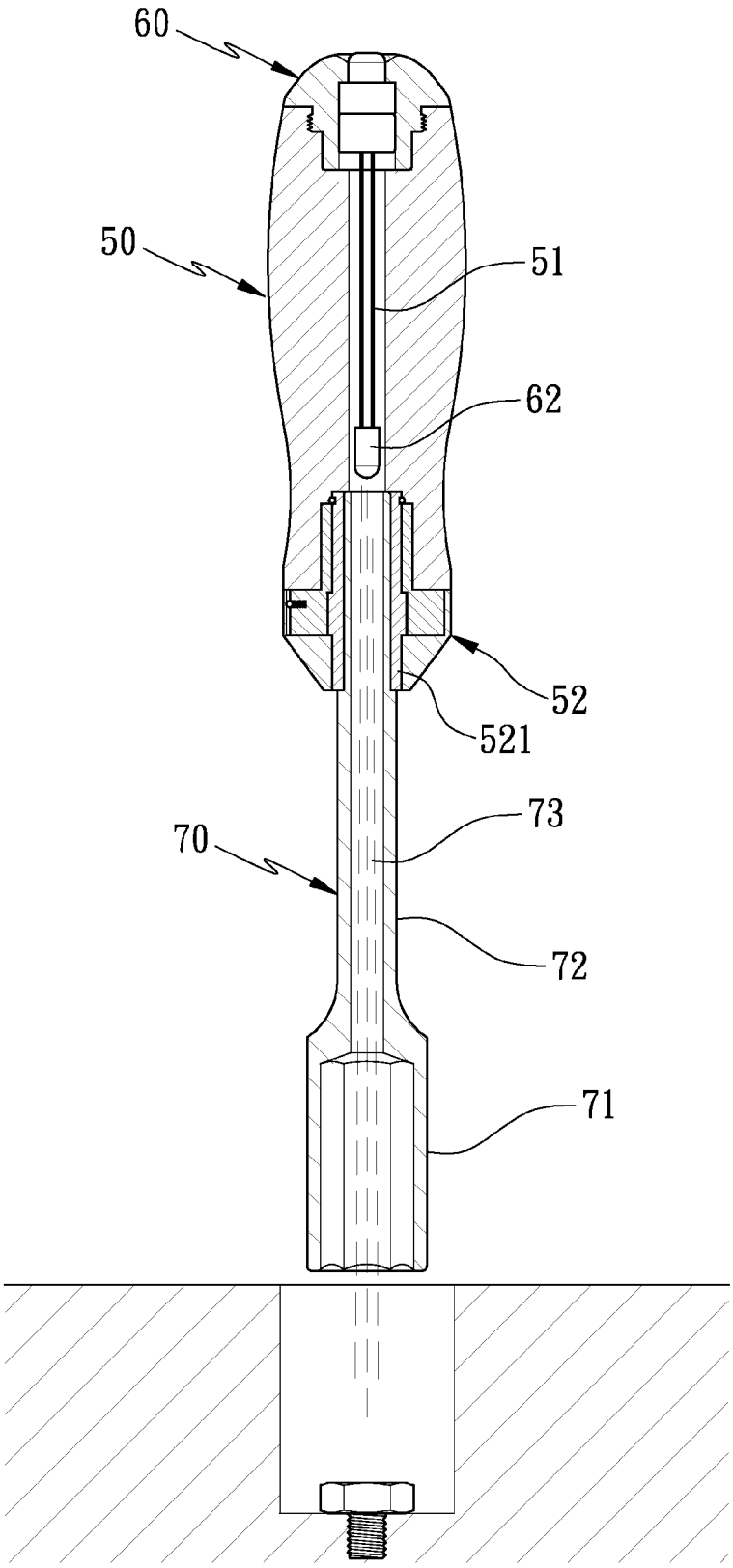
FIG. 9 is also another cross sectional view showing the operation of the handheld illumination device according to the second embodiment of the present invention.

As shown in FIG. 8, in operation, the shank 72 of the operating member 70 is inserted into the connecting portion (i.e., the ratchet assembly 52) of the body 50, and the coupling segment 74 inserts into the fitting tube 521 of the ratchet assembly 52 so that the body 50 drives the operating member 70 to rotate by means of the connecting portion (i.e., the ratchet assembly 52), thus connecting or disconnecting the tool parts. As illustrated in FIG. 9, when turning on the lamp module 60, the light-emitting element 62 emits light via the through hole 51 of the body 50, the fitting tube 521 of the ratchet assembly 52, and the groove 73 of the shank 72 so as to illuminate an work position relative to the working segment 71 of the operating member 70, such that when the handheld illumination device is operated in a narrow space, it illuminates the work position clearly even though the body 50 cannot be inserted into the narrow space. In addition, the light-emitting element 62 is fixed in the body 50, thus preventing the light emitting element 62 from impact damage.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A handheld illumination device comprising:

a body held by a user and including a through hole defined in the body, a connecting portion formed on a front end of the body, and a holding portion arranged on a rear end of the body;

an operating member including a working segment defined on a front end thereof, a shank formed on a rear end of the operating member and inserted into the connecting portion of the body, the shank having a groove defined therein and communicating with the working segment;

a lamp module fixed in the holding portion of the body by ways of a seat in which a light-emitting element, a battery pack, and a control button are disposed, the light-emitting element emitting light via the through hole of the body and the groove of the shank so as to illuminate a work position relative to the working segment of the operating member.

2. The handheld illumination device as claimed in claim 1, wherein the connecting portion of the body is two slots formed on two sides of the through hole.

3. The handheld illumination device as claimed in claim 2, wherein the shank has two tabs secured on two sides of an outer wall thereof, such that the two tabs retain with the two slots of the through hole so that the body drives the operating member to rotate by using the connecting portion.

4. The handheld illumination device as claimed in claim 1, wherein the connecting portion of the body is a ratchet assembly with a fitting tube.

5. The handheld illumination device as claimed in claim 4, wherein the shank has a coupling segment extending outwardly from a rear end thereof so that when the shank is inserted into the fitting tube of the ratchet assembly, the body drives the operating member by ways of the connecting portion.

6. The handheld illumination device as claimed in claim 1, wherein the seat is screwed in the holding portion of the body.

* * * * *